United States Patent [19]

Blackman

[11] Patent Number: 4,693,090

[45] Date of Patent: Sep. 15, 1987

[54] THERMALLY POWERED ENGINE UTILIZING THERMALLY POWERED VALVES

[76] Inventor: Peter M. Blackman, 16035 N. 43rd St., Phoenix, Ariz. 85032

[21] Appl. No.: 919,469

[22] Filed: Oct. 16, 1986

[51] Int. Cl.[4] ..... F25B 1/00

[52] U.S. Cl. ..... 62/116; 60/593; 62/6; 62/467

[58] Field of Search ..... 62/6, 116, 467; 60/593

[56] References Cited

U.S. PATENT DOCUMENTS

| | | | |
|---|---|---|---|
| 2,986,907 | 6/1961 | Hoop | 62/116 |
| 3,048,022 | 8/1962 | Clary | 62/116 |
| 3,188,821 | 6/1965 | Chellis | 62/6 |
| 3,803,857 | 4/1974 | Ishizaki | 62/6 |
| 4,375,749 | 3/1983 | Ishizaki | 62/6 |
| 4,391,103 | 7/1983 | Sarcia | 62/6 |
| 4,617,801 | 10/1986 | Clark, Jr. | 62/467 X |

*Primary Examiner*—Albert J. Makay
*Assistant Examiner*—Steven E. Warner
*Attorney, Agent, or Firm*—Edward W. Hughes

[57] ABSTRACT

A thermally powered engine has a pair of power cylinders with each power cylinder defining a closed interior space. A power pistin is reciprocally mounted in the interior space of each power cylinder with each piston dividing the interior of its cylinder into upper and lower portions. A liquid piston interconnects the upper portions of the two power cylinders. First mechanically powered valves having two states control the flow of the working fluid of a heat transfer loop through the lower portions of each power cylinder. A second mechanically powered valve causes the first mechanically powered valve to change state so that movement of the power pistons in the pair of power cylinders is substantially 180° out of phase.

18 Claims, 3 Drawing Figures

THERMALLY POWERED ENGINE UTILIZING THERMALLY POWERED VALVES

BACKGROUND OF THE INVENTION

1. Field of the Invention

This invention is in the field of thermally powered heat transfer systems.

In particular, the invention is an improvement to and an extension of the Thermally Powered Engine by Robert W. Clark, Jr., application Ser. No. 803,549 filed on Dec. 2, 1985, now U.S. Pat. No. 4,617,801.

2. Description of the Prior Art

The thermally powered engine disclosed in the aforementioned application comprises one or more pairs of power cylinders, each power cylinder having associated with it a powered cylinder for converting thermal energy into useful heating, cooling, or mechanical work. Each of the power cylinders has a piston reciprocally mounted within, with each piston being rigidly connected to a piston mounted within the associated powered cylinder. Each of the pistons in the power cylinders divides its respective power cylinder into two portions, typically an upper and lower portion. A flexible diaphragm is mounted in the lower interior space or portion of each power cylinder. The space enclosed between the diaphragm and the lower end of the cylinder defines a power chamber. The power chambers of each pair of power cylinders are part of a closed heat transfer loop which includes a working fluid, an evaporator, and a condenser. The difference in temperature between the evaporator and the condenser produces a pressure differential between the evaporator and the condenser, and this pressure differential is used to exert a force on one of the power pistons. In addition, the upper portion of each power cylinder is filled with a second fluid. Connecting means is provided for connecting the upper portions of the power cylinders together, to allow the second, or control, fluid to act as a liquid piston, traveling between, or coupling, the two cylinders. Thus, when a piston in one of the power cylinders travels upwardly, the second, or control fluid in the upper portion of that cylinder is forced into the upper portion of the adjacent cylinder, which in turn causes the piston in the adjacent cylinder to travel downwardly. Thus, the pistons in the two power chambers move substantially 180° out of phase with one another. The downward motion of one of the pistons causes the diaphragm in the lower portion of the cylinder for that piston to flex downwardly, which in turn activates a switch for controlling electrically powered solenoid valves to regulate the flow of the working fluid into and out of the power chambers of the working fluid in the closed heat transfer loop. Each change in position of the valves causes a change in the flow path of the working fluid in the heat transfer loop, which in turn causes the pistons to alternately reciprocate and to generate power in a cyclical manner.

The aforementioned thermal engine is capable of utilizing a relatively small temperature difference to perform a number of useful functions, such as heating water for a home, powering a refrigeration system or a heat pump, acting as a compressor for compressing gas, pumping liquids, or performing other kinds of mechanical work. A major advantage of this system is that it can be powered by naturally occurring temperature differences, by solar energy, or by any fuel including biomass.

One drawback of the aforementioned thermal engine, however, is that a certain amount of electrical energy is required to power the solenoid valves which control the flow of the working fluid in the closed heat transfer loop into and out of the power chambers. Because the engine requires an electrical power source independent of the engines, it can not be easily utilized in developing nations or in other remote areas of the world where electric power is not readily available.

A need therefore exists for a thermally powered engine which is not dependent on a source of electric power.

SUMMARY OF THE INVENTION

The present invention eliminates the shortcomings of the aforementioned thermally powered engine by replacing the electric solenoid valves which control the flow of the working fluid in the closed heat transfer loop with thermally powered mechanical valves. A temperature difference of 20° F. or more between the evaporator and the condenser in the heat transfer loop produces a pressure differential which is used to alternately increase the pressure first on one side of the valve and then on the other side of the valve, causing the valve to reciprocate between two positions, or two states. The thermally powered valve of the present invention can be used as a two-way, three-way, or four-way valve depending on the number of inputs to the valve body.

Accordingly, it is an object of the present invention to provide a thermally powered engine with valves which do not require any electrical power to operate.

Another object of the invention is to provide thermally powered valves for controlling the flow of working fluid in a closed loop heat transfer system with energy derived from the working fluid providing the power for moving the valves, or causing the valves to change state.

Still another object of the invention is to provide pairs of thermally powered valves for a thermally powered engine in which a change in position, or state, of one of the valves causes a change in position, or state, of the other valve.

BRIEF DESCRIPTION OF THE DRAWINGS

Other objects, features and advantages of the invention will be readily apparent from the following description of certain preferred embodiments thereof, taken in conjunction with the accompanying drawings although variations and modifications may be effected without departing from the spirit and scope of the novel concepts of the disclosure, in which.

DESCRIPTION OF THE PREFERRED EMBODIMENTS

Figure 1:
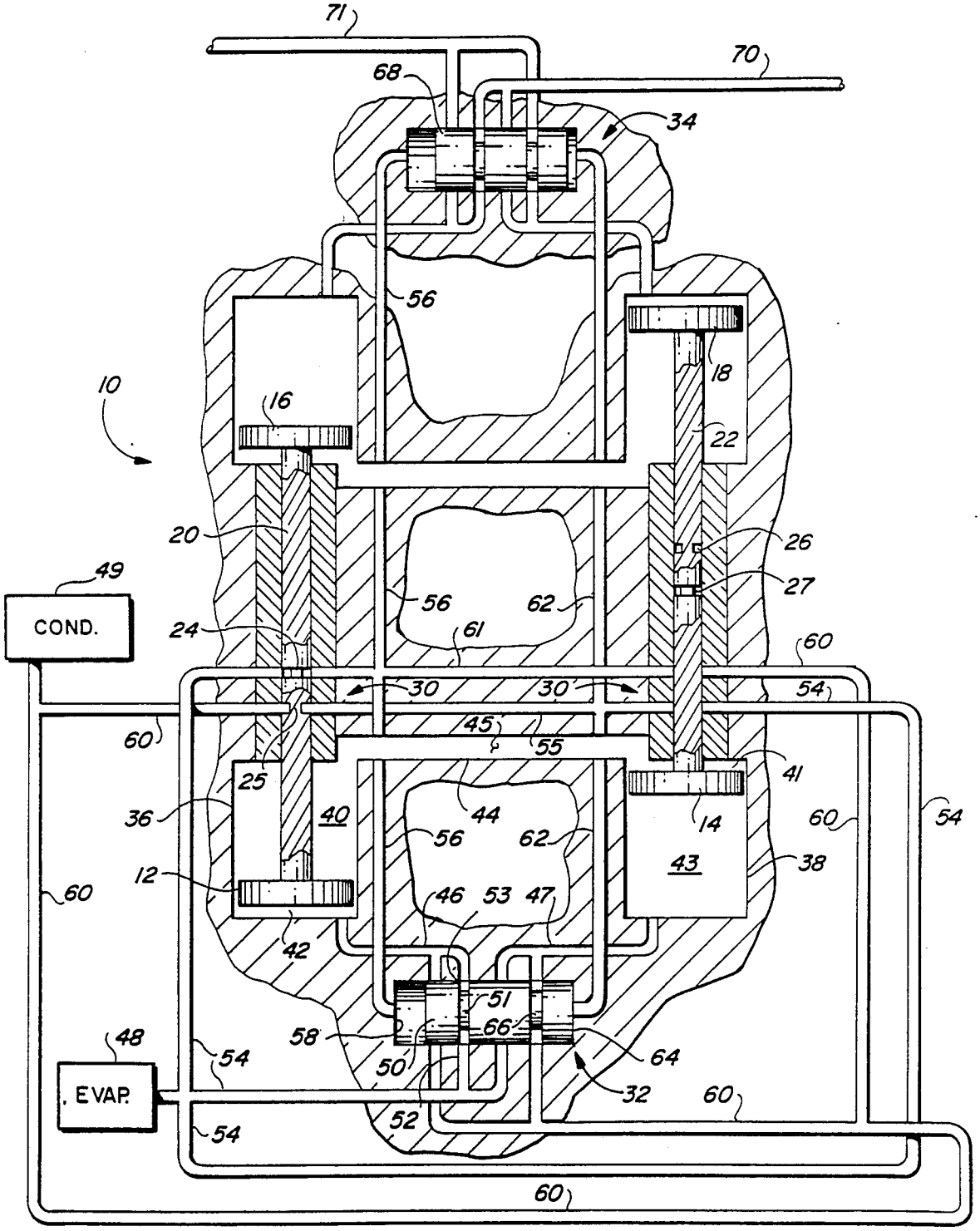
FIG. 1 is a schematic view showing a thermally powered engine utilizing thermally powered valves of the present invention.
Figure 2:
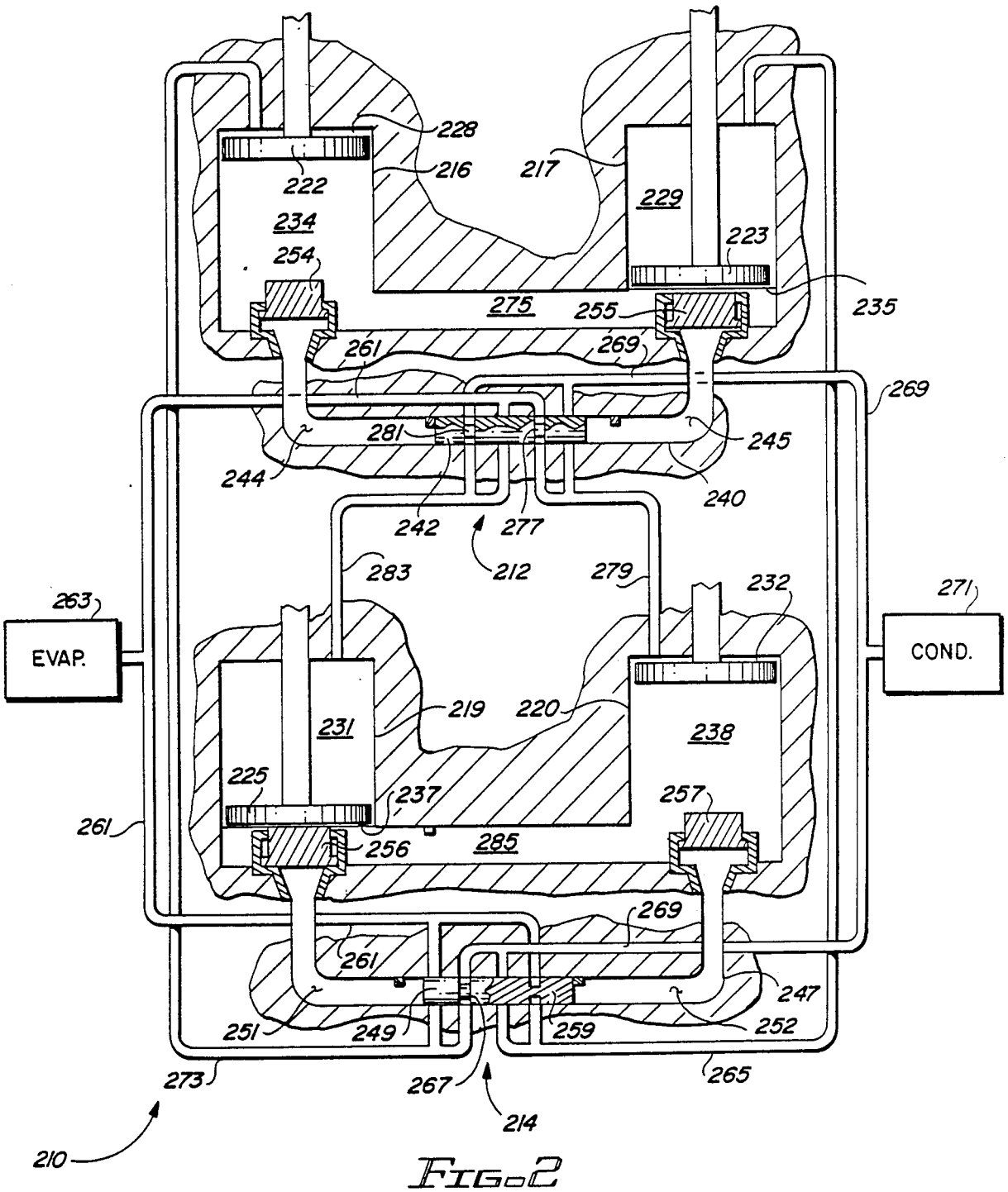
FIG. 2 is a schematic view showing another embodiment of a thermally powered engine utilizing thermally powered valves.
Figure 3:
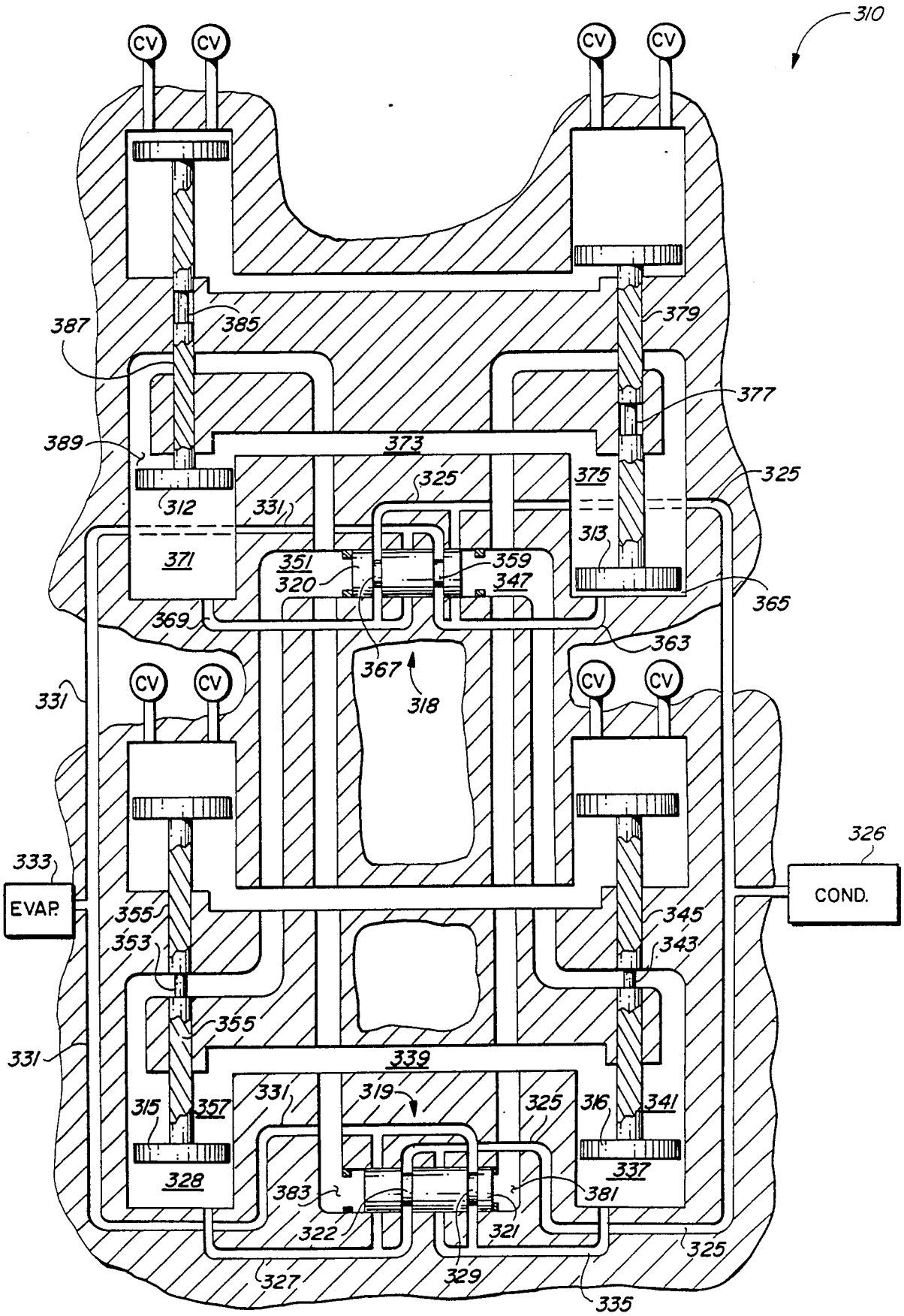
FIG. 3 is a schematic view showing still another embodiment of a thermally powered engine, in which the thermally powered valves change state when one set of power pistons are in midstroke.

The embodiments of the thermally powered engine and thermally powered valves illustrated in FIGS. 1–3 teach the use of thermally powered valves on the power side of the Clark engine. Thermally powered valve can also be used on the powered, or work, side of a Clark engine as is illustrated in FIG. 1. Valving such as that illustrated in FIG. 1 which is incorporated into the powered side of the Clark engine is used when a Clark engine produces power for air-conditioning or for heat pumps, but is not necessary when compressing air or pumping water. In the later cases check valves such as are illustrated in FIG. 3 can be used.

In FIG. 1 thermally powered engine 10 has two power pistons 12 and 14, and two powered pistons 16 and 18. Power piston 12 is rigidly connected to powered piston 16 by piston rod 20, and power piston 14 is rigidly connected to powered piston 18 by piston rod 22. Piston rods 20 and 22 are each provided with circumscribed grooves 24, 25, 26, and 27 which together with conventional valve ports define thermally powered valve assembly 30. Another pair of thermally powered valve assemblies 32, and 34 are also provided. The function and structure of valve assemblies 30, 32, and 34 are described below.

Each of the power pistons 12, and 14, is reciprocally mounted within its associated power cylinder 36, 38 with a piston dividing its respective power cylinder into upper portions 40, 41 and lower portions 42, 43. A fluid passage 44 connects the upper portion 40 of power cylinder 36 to the upper portion 41 of power cylinder 38. The upper portions 40, and 41 of the two cylinders 36, 38 and fluid passage 44 are filled with a fluid which is preferably a liquid such as polyethylene glycola. This fluid forms fluid piston 45 interconnecting the two portions 40, and 41. The lower portions 42, and 43 of cylinders 36, and 38 communicate with conduits 46, and 47 which are connectable with either a conventional evaporator 48 or condenser 49 depending on the position or location of thermally powered valve, or valve plug, 50 of valve assembly 32.

When thermally powered pistons 12, and 14 and valve plug 50 are in the positions illustrated in FIG. 1, circumferential groove 51 of valve plug 50 and valve ports 52 and 53 are aligned with vapor pipe 54 which is in communication with evaporator 48, and with conduit 56 which is in communication with the first end 58 of thermally powered valve assembly 32 through circumferential groove 24 of valve assembly 30. Circumferential groove 66 of valve plug 50 is aligned with vapor pipes 47 which is connected to lower portion 43 of cylinder 38 and vapor pipe 60. Vapor pipe 60 is in communication with condenser 49. Circumferential groove 25 of valve assembly 30 is aligned with vapor pipe 60 which is connected to condenser 49 and conduit 55 which is connected to conduit 62 which is in communication with the second end 64 of valve assembly 32. Because of the pressure differential between evaporator 48 and condenser 49 with the pressure of the working fluid in evaporator 48 being higher than that in condenser 49 the pressure at the first end 58 of valve assembly 32 is higher than the pressure at its second end 64 which causes the valve plug 50 to remain in its right hand position as illustrated in FIG. 1. The pressure differential between the two chambers 42 and 43 causes piston 12 to move in an upwardly direction and causes the liquid piston 45 to move toward power cylinder 38, driving piston 14 toward the bottom of piston 38. When the thermally powered piston 14 has completed its power stroke, valve ports 26, and 27 of the other half of valve assembly 30 are aligned with vapor pipes 60 and 54 connecting condenser 49 to vapor pipe 61 which is connected to vapor pipe 56, and evaporator 48 to vapor pipe 55 which is in turn connected to conduit 62. Conduit 62 is connected to the second end 64 of valve assembly 32, and conduit 56 is connected to the first end 58 of valve assembly 32. The result is a pressure differential across valve plug 50 of valve assembly 32 which causes valve plug 50 to move from right to left.

Groove 51 in valve plug 50 when valve plug 50 is in its leftmost position, which is not illustrated, is aligned with vapor pipe 60 leading to condenser 49 and conduit 46 leading to chamber 42 beneath piston 12. Groove 66 is aligned with vapor pipe 54 connected to evaporator 48 and conduit 47 which is connected to chamber 43 beneath piston 14. As a result the pressure in chamber 43 will be higher than the pressure in chamber 42. This pressure differential between chambers 42, and 43 will cause piston 14 to move upwardly forcing the liquid in the liquid piston 45 to move into chamber 40 of power cylinder 36 causing piston 12 to move downwardly. When pistons 14 and 12 return to the positions illustrated in FIG. 1, one cycle of the operation of thermal engine 10 has been completed so that the cycle is ready to begin again.

Thermally powered valve 34 is part of the powered end of thermally powered engine 10 and its valve plug 68 moves in phase with the thermally powered valve plug 50 of valve assembly 32.

Valve assembly 32 has two states which coincide with the positions, or states, of valve plug 50 in valve assembly 32. Valve assembly 32 controls the application of the higher pressure working fluid from evaporator 48 to one or the other of the power portions 42, 43 of power cylinders 36, 38 and connects the other power portion of condenser 49 so that useful work can be performed by thermally powered engine 10. The state of valve assembly 32 is changed by operation of valve assembly 30 which causes the pressure at the ends 58, 64 of valve assembly 32 to change at the completion of each power stroke by a power piston 12, or 14. The use of piston rods 20, 22 connected to powered pistons 12, and 14 synchronizes the changing of state of control valve means 32 and 34 with the operation of the power pistons 12, 14 of the engine 10.

In FIG. 1, valve assembly 34, the powered cylinders in which powered pistons 16, 18 are reciprocally mounted, and powered pistons 16, 18 can function as the compressor of an air conditioning system or heat pump, with conduit 70 being connected to a second conventional condenser and conduit 71 being connected to a second conventional evaporator. Neither the second evaporator nor second condenser are illustrated in FIG. 1.

In FIG. 2 another embodiment of thermally powered engine 210 is illustrated. Engine 210 has two thermally powered valves 212, and 214 and two pairs of power cylinders 216, 217, 219, 220. Each of the power cylinders has a power piston 222, 223, 225, and 226 reciprocally mounted within it, with each piston dividing the interior space of its associated power cylinder into an upper chamber 228, 229, 231, and 232 and a lower chamber 234, 235, 237, and 238.

Thermally powered valve 212 is located in a passageway 240 connecting chamber 235 of power cylinder 217 to chamber 234 of power cylinder 216. Valve, or valve plug, 242 divides passageway 240 into two chambers 244, and 245, each of which is filled with a control fluid which preferably is a liquid such as polyethylene glycol. Similarly, thermally powered valve 214 is located in passageway 247 connecting lower chamber 237 of power cylinder 219 with lower chamber 238 of power cylinder 220. Valve, or valve plug 249 divides passageway 247 into two chambers 251, and 252. Each of the chambers 251, and 252 is filled with a control fluid. In addition, each power cylinder 216, 217, 219, and 220 has a plunger 254, 255, 256, and 257 located in its bottom surface in communication with passageways 240, and 247 in which the thermally powered valves 242, and 249 are located. Thus, when any of the power pistons 222, 223, 225, and 226 moves downwardly to the maximum extent or degree, it depresses its associated plunger 254, 255, 256 or 257, increasing the pressure of the control fluid on one side or the other of thermally powered values 242, and 249, which causes that value to shift from right to left, or left to right.

When engine 210 has the configuration illustrated in FIG. 2, circumferential groove 259 of valve 249 is aligned with vapor pipe 261 connected to evaporator 263, and conduit 265 communicating with chamber 229 above piston 223 of power cylinder 217. Groove 267 of valve 249 is aligned with vapor pipe 269 leading to condenser 271 and conduit 273 leading to chamber 228 above piston 222. The pressure differential between chambers 228 and 229 causes piston 223 to move downwardly, pushing the liquid piston 275 connecting chambers 234 and 235 to the left, which pushes piston 222 upward. When piston 223 reaches the bottom, or end of its power stroke, as illustrated in FIG. 2, plunger 255 is pushed down, increasing the pressure of the fluid in chamber 245 which moves valve plug 242 from right to left and moves the fluid in chamber 244 to the left, which in turn moves plunger 254 upwardly. When valve 242 moves, it changes the flow of the working fluid to cylinders 219 and 220.

In FIG. 2, groove 277 of valve 242 is aligned with conduit 261 leading from evaporator 263 and conduit 279 leading to chamber 232 above piston 226. Groove 281 is aligned with conduit 269 leading to condenser 271 and conduit 283 leading to chamber 231 above piston 225. The pressure differential between chambers 231 and 232 causes piston 226 to move down, pushing liquid piston 285 to the left and pushing piston 225 upwardly.

When piston 226 reaches the bottom of its power stroke, it depresses plunger 257, increasing the pressure of the fluid in the chamber 252 which moves valve 249 from right to left, causing the fluid in chamber 251 to move plunger 256 upwardly. When thermally powered valve 249 moves as described above, it changes the flow of the working fluid in the heat transfer loop to cylinders 216, and 217.

When valve 249 is moved to the left, circumferential groove 259 in valve 249 is aligned with vapor pipe 269 leading to condenser 271 and conduit 265 leading to chamber 229 above piston 223. Circumferential groove 267 is aligned with vapor pipe 261 leading to evaporator 263 and conduit 273 leading to chamber 228 above piston 222.

The resulting pressure differential between chambers 229, and 228 causes piston 222 to move down, pushing the liquid piston 275 to the right and pushing piston 223 up. When piston 222 gets to the bottom of its stroke, or completes its power stroke, it depresses plunger 254, increasing the pressure of the fluid in chamber 244, which moves valve plug 242 from left to right, pushing the fluid in chamber 245 to the right and causing plunger 255 to move upwardly. When thermally powered valve 242 moves, it changes the flow of the working fluid to cylinders 219 and 220.

Circumferential groove 281 of valve 242 when moved to the right is aligned with conduit 261 connected to evaporator 263 and conduit 283 leading to chamber 231 above piston 225. Circumferential groove 277 when valve 242 is in this state is aligned with vapor pipe 269 leading to condenser 271 and conduit 279 leading to chamber 232 above piston 226. The resulting pressure differential between chamber 231 and 232 causes piston 225 to move downward, pushing piston 226 upward. When piston 225 reaches the end of its power stroke, it depresses plunger 256 which decreases the pressure of the fluid in chamber 251, moving valve 249 from left to right which pushes the fluid in chamber 252 to the right and causes plunger 257 to move upwardly. At this point, one complete cycle of the operation of the power side of the thermally powered engine 210 has been completed and the cycle starts over again.

In FIG. 2 only one pair of the four power pistons is moving at any given time. When one of the pistons of pair 219, 220, or pair 216, 217 finishes a power stroke, it actuates valve 212, or 214 and then one of the pistons of the other pair of power pistons executes a power stroke.

In FIG. 3 there is illustrated an embodiment of a thermally powered engine 310 in which all four power pistons 312, 313, 315 and 316 of engine 310 are moving almost all the time and only stop long enough for thermally powered valve assemblies 318, 319 to change position, or state. Flow of working fluid through the power cylinders within which power pistons 312, 313, or 315, 316 are located is reversed when the other pair of power pistons is in mid-stroke. Thus each pair of power pistons is either a half stroke ahead or a half stroke behind the other pair. The valve, or valve plugs 320, 321 of thermally powered valves 318 and 319 move left to right and right to left at the middle of a power piston power stroke. Thermally powered valve 320 moves when piston 315 and 316 are in the middle of either their power or exhaust strokes to change the flow of working fluid to the cylinders of pistons 312 and 313. Thermally powered valve 321 moves when pistons 312 and 313 are in the middle of either their power or exhaust strokes. Valve assembly 319 controls the flow when pistons 312 and 313 reach the middle of their strokes, pistons 315 and 316 are at the end of their strokes. When piston 312 and 313 are at the middle of the power, or exhaust strokes and piston 313 is moving upwardly, fluid in chamber 375 is forced through circumferential groove 377 in piston rod 379 to of working fluid to cylinders of pistons 315 and 316 so that when valve assembly 319 changes state, the flow of working fluid to the cylinders of pistons 315 and 316 changes or reverses.

In FIG. 3, grooves 322 of valve plug 321 are aligned with vapor pipe 325 leading from condenser 326 and conduit 327 leading to chamber 328 below piston 315. Groove 329 is aligned with vapor pipe 331 from evaporator 333 and conduit 3 35 leading to chamber 337 below piston 316. The pressure differential between chambers 328 and 337 causes piston 316 to move upward, pushing liquid piston 339 to the left, which pushes piston 315 down. When pistons 315 and 316 reach the middle of a stroke as shown in FIG. 3, fluid in chamber 341 is forced through circumferential groove, or valve port, 343 in piston rod 345 to chamber 347, moving thermally powered valve, or valve plug, 349 from right to left, pushing the fluid in chamber 351 through circumscribed groove 353 in piston rod 355 to chamber 357.

Groove 359 in valve plug 320 is now aligned with vapor pipe 331 leading to evaporator 333 and conduit 363 leading to chamber 365 beneath piston 313. Groove 367 is aligned with vapor pipe 325 leading to condenser 326 and conduit 369 leading to chamber 371 beneath piston 312. The resulting pressure differential between chamber 371 and 365 causes piston 313 to move up, pushing the liquid piston 373 to the left and pushing piston 312 down. chamber 381, pushing thermally powered valve 321 from right to left and moving the fluid in chamber 383 through circumscribed groove 385 in piston rod 387 into chamber 389 above piston 312. Groove 322 in valve plug 321 is now aligned with vapor pipe 331 leading from evaporator 333 and conduit 327 leading to chamber 328 below piston 315. Groove 329 is aligned with vapor pipe 325 leading from condenser 326 and conduit 335 leading to chamber 337 beneath piston 316.

When piston 315 reaches the bottom of its stroke, the high pressure vapor from evaporator 333 is switched to chamber 328 pushing piston 315 upward and piston 316 downward. When piston 315 and 316 are at the middle of their strokes, piston 312 and 313 will be at the end of their strokes. With piston 315 moving upwardly, fluid in chamber 357 is moved through circumferential groove 353 in piston rod 355 to chamber 351 moving valve plug 320 from left to right, forcing the fluid in chamber 347 through circumferential groove 343 in piston rod 345 to chamber 341 above piston 316. Circumferential groove 367 in valve plug 320 is now aligned with conduit 331 leading from evaporator 333 and conduit 369 which communicates with chamber 371. Groove 359 is aligned with conduit 325 leading to condenser 326 and conduit 363 leading to chamber 365. This causes piston 312 which has now reached the bottom of its stroke to move upwardly. When pistons 312 and 313 are in the middle of their strokes, pistons 315 and 316 will be at the end of theirs. When piston 312 moves upward, fluid in chamber 389 is forced through circumferential groove 385 in piston rod 387 causing the control fluid in chamber 389 to push bottom of its stroke to move upwardly. When pistons 312 and 313 are in the middle of their strokes, pistons 315 and 316 will be at the end of theirs. When piston 312 moves upward, fluid in chamber 389 is forced through circumferential groove 385 in piston rod 387 causing the control fluid in chamber 389 to push thermally powered valve 321 from left to right moving the fluid in chamber 381 through circumferential groove 377 into chamber 375. At this point one complete cycle of the thermally powered engine 310 has been completed and the cycle then begins again.

While the principles of the invention have been made clear in the illustrated embodiments, it will be immediately obvious to those skilled in the art that FIGS. 1, 2, and 3, show only some of the ways a thermally powered valve can be used with a thermally powered engine. Many modification of structure, arrangement, proportions, the elements, materials and components used in the practice of the invention may be made in order to adapt the engine and its control valves for specific environments and operation requirements, without departing from these principles. The appended claims are therefore intended to cover and embrace any such modifications within the limits only of the true spirit and scope of the invention.

I claim:

1. A thermally powered engine comprising:

a pair of power cylinders, each power cylinder defining a closed interior space, with each power cylinder having an upper and lower end;

a power piston reciprocally mounted within the interior space of each cylinder, each power piston dividing the interior space of each cylinder into a first portion and a second portion;

a piston rod connected to each power piston and projecting through an end of each cylinder;

a control fluid substantially filling the first portions of the two cylinders;

means for permitting the control fluid to flow between the first portions of the two power cylinders;

a heat transfer loop including a working fluid, an evaporator, a condenser and the second portion of each of the two cylinders;

mechanically powered control means for controlling the flow of the working fluid through the heat transfer loop and through the second portions of each of the power cylinders so that the movement of the power pistons in each of the cylinders is out of phase, said mechanically powered control means including first and second valve assembly means, each valve assembly means having a first and a second state; the first valve assembly means controlling the flow of working fluid through the second portions of each of the cylinders so that when the first valve assembly means is in its first state one piston executes a power stroke and when the first valve assembly means is in its second state the other piston executes a power stroke; the second valve assembly means in its first state causing the first valve assembly to be placed in its first state and when the second valve assembly is in its second state causing the first valve assembly to be placed in its second state; and means for converting the motion of two piston rods into useful work.

2. A thermally powered engine as defined in claim 1 in which the first valve assembly means includes a movable valve plug having a plurality of circumferential grooves.

3. A thermally powered engine as defined in claim 2 in which the second valve assembly means includes the piston rods connected to each power piston.

4. A thermally powered engine as defined in claim 1 comprising a second pair of power cylinders, with a power piston reciprocally mounted in each power cylinder dividing the interior space of each cylinder into a first portion and a second portion, a control fluid substantially filling the first portions of the two cylinders, and means for permitting the control fluid to flow between the first portions of the two power cylinders of the second pair of power cylinders, the second valve assembly means for controlling the flow of the working fluid through the second portions of each of the power cylinders of the second pair so that movement of the power pistons is substantially 180° out of phase.

5. A thermally powered engine as defined in claim 4 in which each of the valve assembly means has two states, and changes its state when a power piston of the pair of power pistons with which the valve assembly means is associated completes a stroke.

6. A thermally powered engine as defined in claim 5 in which the valve assembly means associated with each pair of power cylinders changes state when a power piston completes a power stroke.

7. A thermally powered engine as defined in claim 6 in which the valve assembly means for the two pair of power cylinders further include a plunger mounted in each power cylinder which is depressed by a power cylinder at the completion of each of its power strokes to change the state of one of the control means.

8. A thermally powered engine as defined in claim 7 in which the pistons of one pair of power cylinders are in motion when the pistons in the other pair are at rest.

9. A thermally powered engine as defined in claim 4 in which each valve assembly means has two states and in which one of the valve assembly means changes state when one pair of powered pistons are substantially in mid-stroke, and the other valve assembly means changes state when the other pair of powered pistons are substantially in mid-stroke.

10. A thermally powered engine comprising:

a pair of power cylinders, each power cylinder defining a closed interior space, each cylinder having an upper and a lower end;

a piston reciprocally mounted within the interior space of each cylinder, the piston dividing the interior space of each cylinder into a first portion and a second portion;

a piston rod connected to each piston and projecting through an end of each cylinder;

a control fluid substantially filling the first portions of the two cylinders;

means for permitting the fluid to flow between the first portions of the two power cylinders;

a heat transfer loop including a working fluid, an evaporator, a condenser and the second portion of each of the two cylinders;

first valve assembly means having a first and a second state for controlling the flow of the working fluid through the heat transfer loop and through the second portions of each of the cylinders so that in its first state one piston executes a power and in its second state, the other piston executes a power stroke, the movement of the pistons being out of phase;

second valve assembly means having a first and a second state for causing the first valve assembly means to change state at the completion of each power stroke by a power piston of a power cylinder; the first valve assembly means controlling the flow of working fluid through the second portions of each of the power cylinders so that when the first valve assembly means is in its first state one piston executes a power stroke and when the first valve assembly means is in its second state the other piston executes a power stroke; the second valve assembly means in its first state causing the first valve assembly to be placed in its first state and when the second valve assembly is in its second state causing the first valve assembly to be placed in its second state;

said first and second mechanically powered valve assembly means being powered by energy derived from the heat transfer loop; and means for converting motion of the two piston rods into useful work.

11. A thermally powered engine as defined in claim 10 in which the first valve assembly means includes a movable valve plug having a plurality of circumferential grooves.

12. A thermally powered engine as defined in claim 11 in which the second valve assembly means includes the piston rods connected to each power piston.

13. A thermally powered engine as defined in claim 10 comprising a second pair of power cylinders, with a power piston being reciprocally mounted in each power cylinder dividing the interior space of each cylinder into a first portion and a second portion, a control fluid substantially filling the first portions of the two cylinders, and means for permittting the control fluid to flow between the first portions of the two power cylinders of the second pair of power cylinders, the second valve assembly means for controlling the flow of the working fluids through the second portions of each of the power cylinders of the second pair so that movement of the power pistons is substantially 180° out of phase.

14. A thermally powered engine as defined in claim 13 in which each of the valve assembly means has two states, and each changes its state when a power piston of the pair of power pistons with which the valve assembly means is associated completes a stroke.

15. A thermally powered engine as defined in claim 14 in which the valve assembly means associated with each pair of power cylinders changes state when a power piston completes a power stroke.

16. A thermally powered engine as defined in claim 15 in which the valve assembly means for the two pair of power cylinders further include a plunger mounted in each power cylinder which is depressed by a power cylinder at the completion of each of its power strokes to change the state of one of the valve assembly means.

17. A thermally powered engine as defined in claim 16 in which the pistons of one pair of power cylinders are in motion when the pistons in the other pair are at rest.

18. A thermally powered engine as defined in claim 10 in which each valve assembly means has two states and in which one of the valve assembly means changes state when one pair of powered pistons are substantially in mid-stroke, and the other valve assembly means changes state when the other pair of powered pistons are substantially in mid-stroke.

* * * * *